US009283800B2

(12) United States Patent
Van Den Bogaard et al.

(10) Patent No.: US 9,283,800 B2
(45) Date of Patent: Mar. 15, 2016

(54) DEVICE FOR HOLDING TOGETHER A STACK OF SHEETS

(75) Inventors: Johannes Adrianus Van Den Bogaard, Helmond (NL); Josephus Petrus Theodorus Van Den Bogaard, Helmond (NL); Theodorus Franciscus Van Den Bogaard, Geldrop (NL)

(73) Assignee: DELTACLIP INTERNATIONAL B.V., Eindhoven (NL)

( * ) Notice: Subject to any disclaimer, the term of this patent is extended or adjusted under 35 U.S.C. 154(b) by 193 days.

(21) Appl. No.: 13/981,726

(22) PCT Filed: Feb. 3, 2012

(86) PCT No.: PCT/EP2012/051854

§ 371 (c)(1),
(2), (4) Date: Jul. 25, 2013

(87) PCT Pub. No.: WO2012/104413

PCT Pub. Date: Aug. 9, 2012

(65) Prior Publication Data

US 2013/0305501 A1 Nov. 21, 2013

(30) Foreign Application Priority Data

Feb. 4, 2011 (NL) ..... 1038563
Feb. 10, 2011 (EP) ..... 11154027

(51) Int. Cl.
*B42F 1/02* (2006.01)
*B42F 1/12* (2006.01)
(Continued)

(52) U.S. Cl.
CPC ... *B42F 1/02* (2013.01); *B42F 1/04* (2013.01); *B42F 1/10* (2013.01); *B42F 1/12* (2013.01); *Y10T 24/208* (2015.01)

(58) Field of Classification Search
CPC ..... B42F 1/10; B42F 1/12; B42F 1/00; B42F 1/02; B42F 1/04; B42F 1/06; Y10T 24/208; Y10T 24/207
USPC ..... 24/67 CF, 67 AR, 67 R
See application file for complete search history.

(56) References Cited

U.S. PATENT DOCUMENTS 2,326,366 A 8/1943 Krenke
2,843,901 A * 7/1958 Bukowski ..... 24/67 CF
D271,213 S * 11/1983 Sato ..... D19/65

FOREIGN PATENT DOCUMENTS

CN 2871216 2/2007
GB 138 962 2/1920

(Continued)

OTHER PUBLICATIONS

International Search Report for PCT/EP2012/051854 mailed Mar. 26, 2012.

(Continued)

*Primary Examiner* — Abigail Morrell
(74) *Attorney, Agent, or Firm* — Nixon & Vanderhye P.C.

(57) ABSTRACT

The invention relates to a device for holding together a stack of sheets which has a good binding quality, is simple, intuitive and quick to attach, offers multiple functionalities, uses sustainable materials and can be used safely. Because of the simple construction the invention can be manufactured cheaply and quickly and offers a good solution for the business market, wherein speed of attachment, good binding quality and a sustainable appearance together with the combined functionalities (joining paper, promotional expression by means of printed logos on the clip, marking possibilities) offers added value in comparison with existing solutions. For the retail market the invention also offers a good alternative to existing solutions. Certain embodiments of the invention are cheap, sustainable, function well and offer numerous possibilities for applications. The function of the invention is based on a number of basic principles, the most important of which are: visually clearly distinguished areas renders the use intuitive, by using a lever arm effect the effort required for fixing is minimized, by using, in certain embodiments, an adhesive layer or a retaining system the fixing requires particularly few actions, whereby the invention is simple, intuitive and functions appropriately.

15 Claims, 14 Drawing Sheets

(51) Int. Cl.
*B42F 1/04* (2006.01)
*B42F 1/10* (2006.01)

(56) References Cited

FOREIGN PATENT DOCUMENTS

| | | |
|---|---|---|
| JP | 2003251958 | 9/2003 |
| JP | 2007245698 | 9/2007 |
| NL | 1011086 | 7/2000 |
| NL | 1011526 | 9/2000 |
| NL | 1 017 399 | 8/2002 |
| WO | WO2006011010 | 2/2006 |

OTHER PUBLICATIONS

Search Report for NL1038563 dated Feb. 4, 2011.

* cited by examiner

Fig.19
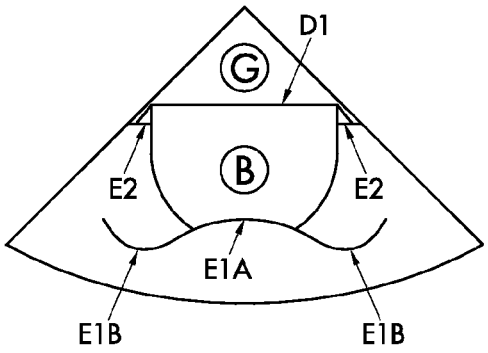
Fig.20
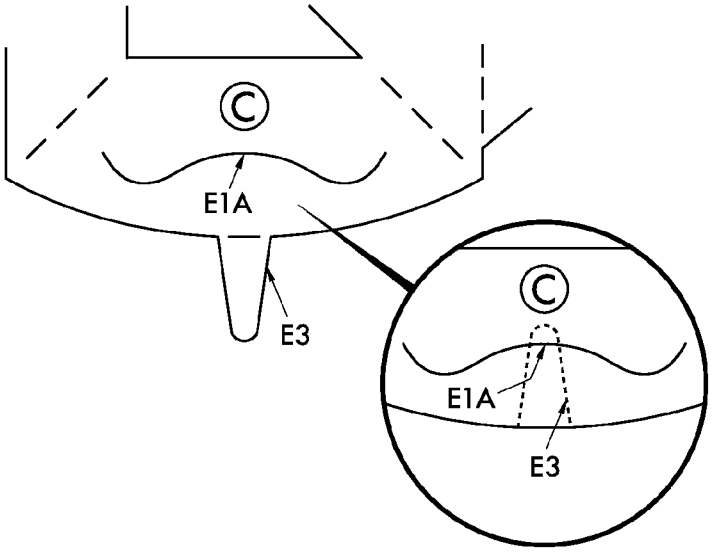
Fig.21

DEVICE FOR HOLDING TOGETHER A STACK OF SHEETS

This application is the U.S. national phase of International Application No. PCT/EP2012/051854 filed 3 Feb. 2012 which designated the U.S. and claims priority to NL 1038563 filed 4 Feb. 2011, and EP 11154027.4 filed 10 Feb. 2011, the entire contents of each of which are hereby incorporated by reference.

TECHNICAL FIELD OF THE INVENTION

The invention relates to a device for holding together an end of a stack of sheets. The invention further relates to an intermediate product for the manufacturing of such a device. The invention also relates to a method for holding together an end of a stack of sheets.

BACKGROUND OF THE INVENTION

The first paperclip was patented in 1867 by Samuel B. Fay. Following this in quite a few new paperclips were patented, wherein the Gem paper clip (the wire clip with three curved parts) is the best known. Where this patent refers to the "traditional paperclip", this means the wire paperclip including all variants which are based on the same function principle. Almost all paperclips acquire their binding power by exerting with the paperclip a clamping force on the stack of sheets, whereby they are joined together. This clamping force is achieved by a combination of the stiffness of the material (metal or plastic) and the shape of the paperclip. Benefits of traditional paperclips are the low costs and intuitive function of the clips. Disadvantages of traditional paperclips are the moderate binding quality (stacks of sheets can fall out from between the stack of connected sheets of paper) and the chance of damaging the paper by the protruding ends of the wire of the paperclips. Another disadvantage of the traditional paperclip is the use of material. Paperclips are made of metal or plastic. These are not sustainable materials, whereby the paperclips have a negative effect on the well-being of the environment. This also applies to the recycling process, wherein the material used for paperclips must be separated from the paper. In addition, traditional paperclips have a single functionality, namely the binding of paper. Traditional paperclips do not have the possibility of combining promotional or illustrative expressions with the binding functionality. The final disadvantage of the traditional paperclips is that, when paperclips are applied to a larger quantity of paper sheets, the paperclip can spring off, whereby the clip itself may cause injury to the user (for example to the eye). Also a paperclip based on clamping force may damage the nails of the user when the clip is attached.

In the past, many improvements have been made to the traditional paperclip to increase the clamping force and prevent damage to the paper (for example U.S. D623.229 S, U.S. 2009/0165260 A1, U.S. 2009/0151129 A1). However the improved designs are usually based on the same connecting principle, namely by exerting a clamping force on the stack of sheets by the material used and by the shape of the paperclip. Hereby the disadvantage remains that sheets of paper can fall out from between the stack of papers joined together. Often alternative improved variants to the traditional paperclip can only be achieved at the cost of other functional requirements and properties in relation to the traditional paperclip, such as higher costs, less intuitive functionality, higher weight and more (non-sustainable) material use.

A second category of paperclips, promotional paperclips to which a promotional or illustrative expression can be applied, works on the same binding principle as traditional paperclips, namely by exerting clamping force on the stack of sheets (examples of this category of paperclips are GB930491, GB1561417, GB1582799, GB1602118). The advantage of this second category of paperclips is the possibility of combining the connecting function with the possibility of applying a promotional or illustrative expression to the paperclips by means of printing. The other disadvantages of the traditional paperclips persist with these paperclips.

A third category of paper binders uses connection by making a perforation through the stack of sheets and joining the sheets together by inserting a form/binder through the perforation (for example rivets, connecting clamps). The advantages of these paper binders is that they have a good binding quality and no sheets can fall out from the stack of joined papers. The disadvantages of this category of paper binders are that the material used (usually metal) is not sustainable, the paper is damaged by the perforation and the paper binders usually fulfill a single function. Also the removal of paper binders of this category is typically more complicated.

Next to the solutions mentioned above, there exists another solution for joining papers, namely by a paper corner device such as disclosed in NL1011526, in which a flat sheet is folded over the paper by folding movements, thus connecting the stack of sheets. The advantages of this paper binder are that the solution offers a good binding quality, no stacks of sheets can fall out from between the stack of papers, several functions can be combined (connecting and illustrative expression), there are no safety risks for the product and the paperclip is made of a sustainable material. Also thanks to the material used, the paperclip can be passed through a shredder and be recycled with old paper even without removing the clip from the stack of sheets. The disadvantage of this solution is the poor user-friendliness of the paperclip. The paperclip is attached by performing six actions (rotating clip, inserting paper, folding paper, folding part of clip, folding other part of clip, insertion of front of clip in recess to fasten the clip). Of these six actions, three are not intuitive. To remove the paperclip from the stack of sheets, all actions must be carried out in reverse order.

Another paperclip is disclosed in NL1011086. This document discloses a compact corner device for holding together a stack of sheets. The holding method of the corner device is characterised by a foldable lever arm with a recess therein, a rigid support which is created on the first folding action of the corner device, an open ridge between a rear surface in which a foldable clamping hook is integrated and a foldable front surface in which the closing corner is integrated. By using a punch form, the corner device can be attached to and removed from the stack of sheets in a number of actions.

One problem with existing solutions is that these are not user-friendly. The existing solutions require many actions from the user, of which a number of actions are not intuitive. The paperclip in NL1011086 is described as flat sheet. The attachment of the paperclip, like the paperclip in patent no. NL1011526, consists of six actions. First the paperclip must be rotated as the paper must be attached to the back side of the clip. Then a retaining arm must be attached behind a front surface by means of folding movement, by pushing this retaining arm into a small recess. Then the stack of sheets must be pushed between this retaining arm and the rear surface. The next step consists of folding the stack of sheets over the retaining arm. This takes place including a clamping corner which is integrated with the rear surface. The penultimate step is folding the front surface over 180° to the front. To attach the paperclip as a final step the closure must be pushed into a recess in the retaining arm. The paperclip is now attached and binds a stack of sheets. The disadvantage is that the paperclip needs six actions to attach it, that the fixing is not intuitive because the clip must be attached on the back side, and the fixing of the retaining arm takes place by partly deforming the retaining arm before this can be pushed into the recess in the rear surface.

Another disadvantage of this paperclip is that there is a protrusion on the side of the paperclip (visible from the front). This is the end of the retaining arm. Because of this protrusion, the paperclip with the stack of sheets cannot or not easily be placed in an envelope as the protrusion catches the back side of the envelope.

SUMMARY OF THE INVENTION

The first object of the invention is to create a device for holding together an end of a stack of sheets, which is user-friendly. The second object of the invention is to create an intermediate product which is necessary for manufacturing of the device according to the invention. The third object of the invention is to create a method for holding together an end of a stack of sheets.

The invention is defined by the independent claims. The dependent claims define advantageous embodiments.

In a first aspect, in accordance with the object of the invention, the invention relates to a device according to claim 1.

The effect of the properties of the invention is as follows. The first wall and the second wall jointly define the space in which the end of the stack of sheets must be placed. The first wall and second wall are joined such that in operational use these need merely be pushed over an end of the stack of sheets, which is a first great advantage for the user who does not need to perform any complex non-intuitive actions. The pivotable auxiliary piece cooperates with the first folding edge which is formed by the first wall in the second opening. The auxiliary piece and the first folding edge are configured and positioned so as to be suitable, in operational use, via a lever arm action on the end of the stack of sheets, for folding over the end of the stack of sheets about the first folding edge in the direction of the first wall. Furthermore, the auxiliary piece is configured such that, in operational use, in unfolded state of the stack of sheets, this protrudes at least at one location further than the end of the stack of sheets so that in folded state of the stack of sheets it can make physical contact with the first wall. Furthermore, the stack of sheets is folded over the entire predetermined distance (with a corner device, this is up to the corner and against the closed edges). The fact that the auxiliary piece protrudes beyond the edge of the sheets has two very great advantages. Firstly this amplifies the lever arm effect (only very little force need be exerted) during bending of the end of the sheets. Secondly the protruding part makes the action for use very intuitive. In fact the user need perform only two steps in fitting the device to the end of the stack of sheets. The first step concerns a step described above of introducing the end in the space so that this protrudes from the second opening. The second step concerns bending the end of the stack of sheets by means of the protruding auxiliary piece. The invention thus creates a very user- friendly and intuitive solution.

It should be noted that NL1011086 describes one of the folding arms as a lever arm. According to the definition of a lever arm, this is not a lever arm. This should rather be described as a retaining arm. In the device according to the invention, however, there is a lever arm effect because the auxiliary piece protrudes beyond the stack of sheets.

In one embodiment of the device according to the invention the auxiliary piece (B) is pivotably attached to the second wall (W2) close to the second opening (O2) via a pivot axis (D1). The pivot axis facilitates the user-friendliness and intuitiveness of the device, because the user can push the auxiliary piece in only one direction. This maximises the lever arm effect on the end of the stack of sheets.

In one embodiment of the device according to the invention, the auxiliary piece (B) protrudes further than the predetermined distance (DST1) by a factor in the range of 1 to 3. The range in this embodiment has been found to be most practical in relation to manufacturing and user-friendliness of the device. However, the invention is not limited to this range.

In one embodiment of the device according to the invention, the auxiliary piece (B) is configured such that it protrudes, in operational use, in unfolded state of the stack of sheets (P), at least at one location so far that in folded state of the stack of sheets (P), it is able to make physical contact with a respective outermost sheet of the stack of sheets at one location beyond the first wall (W1). This embodiment has the advantage that the auxiliary piece can be fastened better, for example by connecting this with the outermost sheet via an adhesive layer (or other adhesion principle).

In one embodiment of the device according to the invention, at least one of the auxiliary piece (B) and a receiving side of the first wall (W1) is provided with an adhesive layer so that the auxiliary piece (B), in operation use, in folded state of the stack of sheets (P), adheres to the first wall (W1). This is a first advantageous variant of a further refined device.

In one embodiment of the device according to the invention, the first wall (W1) is provided with a cut (E1A), which is positioned and configured such that the auxiliary piece (B), in operational use, in folded state of the stack of sheets (P), can be pushed at least partly into the cut (E1A), securing the auxiliary piece (B). This is a second advantageous embodiment of a further refined device. An additional advantage of this embodiment if that the auxiliary piece can be released more easily, whereby the user-friendliness, but also the sustainability of the product increases.

In one embodiment of the device according to the invention, the cut (E1A) is formed such that it defines a protruding part (E1A) of the first wall (W1), which hinges about a fictitious axis from the plane of the first wall (W1) on exertion of a force (FRC) on part of the first wall (W1) which, viewed from the first folding edge (E1), is positioned beyond the cut (E1A), wherein the force (FRC) has a component perpendicular to the plane of the first wall (W1). This embodiment improves the user-friendliness even further, because the insertion of the auxiliary piece in the cut becomes even simpler. Aspects of this embodiment are illustrated in FIGS. 22 and 23.

In one embodiment of the device according to the invention, on an inside of the first wall (W1) there is provided a guiding construction (E3), which guiding construction (E3) extends over at least part of the cut (E1A), (E1B) in order to prevent, in operational use, on insertion of the stack of sheets (P) into the cavity, one or more sheets of the stack of sheets (P) being pushed from the inside through the cut (E1A, E1B). This embodiment improves the user-friendliness still further, because it prevents, on insertion of the stack of sheets, these sheets being pushed into the cut. This prevents frustration in the user.

In one embodiment of the device according to the invention at least one of the first wall (W1) and auxiliary piece (B) on one side is provided with an adhesive layer. This embodiment is very advantageous because in this way a stackable device is obtained, which firstly can be packed very easily in large numbers, but which, secondly, can very easily be retrieved from a stack for use. Aspects of this embodiment are illustrated in FIGS. 15 and 16.

An advantageous variant of the embodiment is obtained if the adhesive layer is attached to the first wall, because in this case the adhesive layer has a double function, namely then it can also be used for fixing the auxiliary piece.

In one embodiment of the device according to the invention the first wall (W1) and the second wall (W2) are formed such that they form a corner device for receiving a corner of the stack of sheets (P). This embodiment is highly advantageous for many reasons. The corner construction is rigid (even when using flexible materials such as paper), small, covers as little as possible the page and facilitates leafing through the stack. However, it must be noted that the corner construction is only one embodiment. In alternative embodiments the construction is such that this can be pushed over the entire width or entire length of the stack of sheets. As long as the construction is provided with a second opening from which the sheets protrude, the same principle can be used, namely that an auxiliary piece is provided which, via a lever arm principle, folds the end of the stack of sheets about the folding edge and in embodiments these are then fixed to the construction or sheets (removably).

In an embodiment of the device according to the invention the corner device has closed edges (CE1, CE2) which together, viewed in projection on a plane of the first wall (W1), form an angle in the range of 60° to 120°. The range given in this embodiment forms the most practical, wherein an angle of 90° is most advantageous in view of the most common paper formats wherein all corners are 90°.

In one embodiment of the device according to the invention the first folding edge (E1) forms an angle in the range of 30° to 60° with at least one of the closed edges (C1, C2) of the corner device. The range given in this embodiment forms the most practical, whereby an angle of 45° is most advantageous in view of the most common paper formats wherein all corners are 90°. An angle of 45° results in the easiest folding of the sheets.

In one embodiment of the device according to the invention a size of the second opening (O2) is configured such that it establishes the predetermined distance (DST1). This applies in particular to the corner device.

In one embodiment of the device according to the invention the length of the second opening (O2) lies in the range of 10 to 60 mm. The range given in this embodiment forms the most practical in view of the formats of the most common paper, which are A3, A4 or A5.

In one embodiment of the device according to the invention the material for each of the first wall (W1), second wall (W2) and auxiliary piece (B) is selected from the group comprising: paper, plastic, wood, metal, biological materials, mixtures of these materials, and other similar materials. The materials listed here can all well be used for the device according to the invention. However the use of paper is very advantageous as the material can be shredded without problems in a shredder.

In one embodiment of the device according to the invention the first wall (W1), second wall (W2) and auxiliary piece (B) are made of one piece. This embodiment is very advantageous because it is very cheap and quick to manufacture. This embodiment is extremely advantageous when the device is made of paper.

In another embodiment of the device according to the invention one or more of the first wall (W1), second wall (W2) and auxiliary piece (B) are attached to the device as separate components. This can for example be achieved by means of gluing, riveting, and other comparable techniques. Within these variants of the invention for example the auxiliary piece (B) can be attached to the device as a separate component. In the light of the invention in any case it is important that the auxiliary piece (B) is attached to be pivotable about at least one pivot point (or pivot axis) and whereby the pivot point, in relation to the folding edge (E1), is positioned, and wherein the auxiliary piece is configured such that this at least at one point protrudes beyond the stack of sheets when, in operational use, these are inserted in the device to the maximum pre-specified distance.

In a second aspect the invention relates to an intermediate product for manufacturing of the device according to the invention. It must be noted that also the intermediate product from which the device is manufactutred enjoys an important advantage of the invention, namely that of user-friendliness, due to the lever arm principle of the auxiliary piece. Such an intermediate product should therefore in the future also be able to be sold as an independent product.

An embodiment of the intermediate product according to the invention corresponds with regards to shape to one of FIGS. 7, 8 and 9, 20, 24 and 28.

A further improved embodiment of the intermediate product is made of one piece, which is advantageous for the manufacturing of the intermediate product. This can be produced by means of cutting out from the flat sheet and punching the folding lines.

In a third aspect the invention relates to a method according to claim 22. The basic principle of the invention can be applied in many ways, also in ways which are not explicitly mentioned in this description. However, all these variants fall under the scope of protection of the claims. In addition all these variants use the method according to the invention which actually comprises two steps. The first step concerns the insertion of the stack of sheets to beyond a folding edge over the entire predetermined distance (for a corner device, this is up to the corner and against the closed edges). The second step concerns folding of the end of the stack of sheets using an auxiliary piece which has a lever arm effect on the end of the stack of sheets. It should be noted that the invention actually connects the stack of sheets together with only one movement, namely that of bending the corners of the sheets using the auxiliary piece. This in itself is a unique feature, which distinguishes the invention from existing paperclips which also work on the folding principle, but in which many actions are required before the sheets in the stack are attached to each other.

In a fourth aspect the invention relates to a stack of devices according to claim 23. An advantageous embodiment of the stack is obtained with great value if at least the respective devices in the stack (at least one but preferably all) are provided with an adhesive layer as described in claim 18 and described in the description variant thereof with double function. Such a stack is illustrated in FIGS. 15 and 16.

BRIEF DESCRIPTION OF THE FIGURES

These and other details of the invention are described below with reference to the Figures, which serve to illustrate the invention, but are not to be considered as restrictive for the invention, wherein:

FIG. 19 shows the rear view of the paper paperclip in FIG. 17 in the case where the auxiliary construction is pushed into the fixing cut and the clip is in closed state;

FIG. 20 shows a detailed image of the flat sheet model of the paper paperclip in FIG. 17 wherein a guiding construction is visible, whereby the stack of sheets on insertion in the paperclip cannot enter the fixing cut;

FIG. 21 shows a detailed view of the guiding construction in FIG. 20 but in closed state, whereby the stack of sheets on insertion cannot enter the fixing cut in the clip;

DETAILED DESCRIPTION OF AN EMBODIMENT

Figure 1:
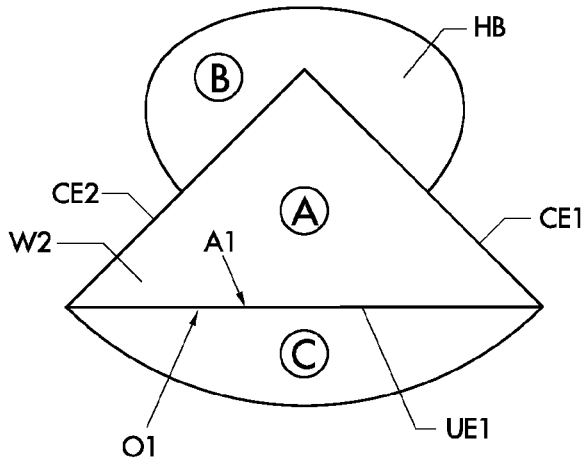
FIG. 1 shows a front view of a paper paperclip in accordance with the first embodiment of the invention in open state, wherein the triangular surface forms the visible front view of the paperclip if the paperclip is attached to the stack of sheets and wherein the round form above the triangular surface represents the auxiliary construction in open state.

In the following description, the emphasis is on a very advantageous embodiment namely the corner device. At some locations other terms are used than those in the introduction and claims. The Figures, however, make it clear which component is meant by which term.

Embodiments of the invention concern a paper paperclip wherein a good solution is offered for all aspects/properties which are relevant for a paper binder, namely the invention guarantees a good binding quality, the invention is cheap to produce, when fitting the invention the stack of sheets to be joined are not damaged, by the material used, manufacturing process and use of specific embodiments of the invention this is environmentally-friendly and sustainable. In addition the invention offers good functionality and is user-friendly when attacjomg and removing the invention. Also specific embodiments of the invention are totally safe for the user to use.

It is also important to emphasise that the invention creates a device for holding together an end of a stack of sheets which is attached with one folding movement (of the auxiliary piece), which is removed with one folding movement, which joins the stack of sheets with one folding movement, and which releases the stack of sheets with one folding movement. This is a very distinct advantage of the invention.

The connecting principle of the invention works by pushing the stack of sheets to be joined into a closed corner device (space defined by two walls as given in the claims) and folding the corners of the stack of sheets, via an auxiliary construction (auxiliary piece) which uses a lever arm action, about a folding line of the closed corner device. Then there are at least two ways for attaching the auxiliary device with which the stack of sheets are joined, namely:

a. Because the paperclip has an adhesive layer on the auxiliary construction or partly or fully on the front and back side of the paperclip, the auxiliary construction needs to be merely folded in the correct direction to attach the auxiliary construction. The adhesive layer holds the auxiliary construction in the closed state whereby the paperclip joins the stack of sheets. Examples of adhesive layers are a glue layer and Velcro tape.
b. By pushing the auxiliary construction into a fixing cut on the back side of the paper paperclip. The fixing cut is opened by pressing on a pivoting construction, whereby the fixing cut opens and thus guarantees insertion of the auxiliary construction. This holds the auxiliary construction in the closed state whereby the paperclip holds the stack of sheets.

According to the inventor a paper binder (device for holding together a stack of sheets or a paperclip) has a number of important functional requirements and properties which a paper binder must fulfil in order to be able to achieve its function, namely to perform the joining of paper well, safely and sustainably. The following functional aspects and properties are deemed relevant or may be relevant for a paper binder:

1. The binding quality according to the definition: good joining of a stack of sheets to be joined, wherein the stack of sheets cannot come loose (not performing its binding function) or wherein sheets of paper can fall out from between other sheets of paper after fixing the paper binder.
2. Damage to the paper according to the definition: not causing damage to the stack of sheets, which are joined while fitting the paper binder or on use of the paper binder.
3. Sustainability according to the definition: the extent of harm to the well-being of the environment. More specifically this is the extent of environmental harm by the type of material used and the availability of the raw materials of the material used, the energy balance in manufacturing of the paper binder or the environmental harm on disposal/discharge of the products and the recycling process.
4. Functionality according to the definition: the possible functions which the paper binder performs or can perform, wherein the primary function is the joining of stacks of sheets, but wherein the primary function can possibly be combined with other functions such as a communication function, a promotional expression or descriptive possibilities.
5. User-friendliness in fitting the paper binder according to the definition: the amount of effort in the terms of force, actions, speed and intuition required to attach the paper binder in order to join a stack of sheets.
6. User-friendliness in removal of the paperclip according to the definition: the amount of effort in terms of force, actions, speed and intuition required to remove the paper binder from the joined stack of sheets.
7. Costs according to the definition: lifecycle costs, comprising all costs incurred over the entire lifecycle of the paper binder, including material costs, manufacturing costs, transport costs, and disposal and recycling costs.
8. Safety according to the definition: the absence of the probability of personal injury.

In the past, many variants of the paperclip or other connection possibilities for paper have been developed. The existing solutions for binding paper such as the wire paperclip, promotional paperclips and rivets, only offer solutions to a number of the above-mentioned functional requirements and properties which are or could be relevant for the paper binder. Embodiments of this invention offer a good solution to all important functional requirements and properties.

The object of the embodiments of the invention is to offer a solution for as many important functional requirements and properties as possible which apply or could apply to the connecting of paper as stated in the problem description. In each case the invention is intended to create a solution which is more user-friendly than the existing (paper) paperclip solutions.

1. Binding quality—specific embodiments of the invention, the paper paperclip, have a good binding quality wherein no sheets of paper can fall out from between the bound sheets of paper. The sheets of paper are fastened by a simple folding movement in conjunction with the adhesive layer on the paperclip or by means of a retaining system.
2. Damage to paper—the paper is not irreparably damaged by specific embodiments of this invention. By a folding movement about a folding edge of the closed corner device of the paper paperclip, small "flaps" are produced on the sheets of paper which have been joined. After removing the paperclip, these flaps can be returned to the original state.
3. Sustainability—by the use of sustainable materials the paper paperclip is environmentally friendly. Also the clip can be disposed of as old paper or passed through the paper shredder for recycling without removing the clip. Also the environmental load in the manufacturing process is substantially lower in terms of energy consumption, $CO_2$ emissions and recycling percentage compared with other paperclip solutions. It is possible to produce the paperclip from completely recycled paper. This is not easily possible without loss of binding quality with the paper paperclips as described in patents NL1011526 and NL1011086.

4. Functionality—specific embodiments of the invention combine the function of joining paper with a function of promotional/illustrative expression. In addition the paper paperclip can be printed, thanks to the material, which adds extra functionality to the paperclip.
5. User-friendliness in fitting the paper clip—specific embodiments of this invention are totally intuitive to fit. The visible front of the paperclip is pushed by the user onto the stack of sheets to be joined. The auxiliary construction which visibly protrudes beyond the visible front side is intuitively folded to move the auxiliary construction out of the visual picture, which is also the objective. The auxiliary construction has the function of folding the stack of sheets by a lever arm effect which is performed flexibly and intuitively. Consequently there are at least two ways of attaching the auxiliary construction with which the stack of sheets are joined, namely:

a. Because the paperclip or auxiliary construction has an adhesive layer on either all or part of the front and back side of the paperclip, the auxiliary construction need merely be folded in the correct direction to attach the auxiliary construction. The adhesive layer holds the auxiliary construction in the closed state whereby the paperclip joins the sheets of paper. Examples of adhesive layers are a glue layer and Velcro tape.
b. By pushing the auxiliary construction into the fixing cut (also referred to as a cut) on the back side of the paper paperclip. This fixing cut is opened by pressing on a pivoting construction, whereby the fixing cut opens and guarantees insertion of the auxiliary construction. This holds the auxiliary construction in the closed state whereby the paperclip joins the stack of sheets.

6. User-friendliness in removing the paperclip—the paperclip need not be removed in the case of disposal of the joined sheets of paper. The paperclip with the stack of sheets can be disposed of as old paper or passed through the paper shredder. But if the paper paperclip must be removed in order for example to copy the bound sheets, then:

a. In the first closing principle merely the auxiliary construction need be removed from the adhesive layer whereby the sheets of paper are no longer retained and can be removed from the paperclip.
b. In the second closing principle merely the fixing cut need be folded back on the rear by exerting pressure on the end of the back, whereby the auxiliary construction comes loose from the fixing cut and the paper can be removed from the clip.

7. Costs—by the material, the simple manufacturing process, the low weight and the optimum manner of recycling, the costs are very low over the entire life cycle. The product can be made from one piece of paper.
8. Safety—there are no safety risks with this invention.

Other advantages given by the invention are:

The rectangular appearance of the sheets of paper joined is not affected by the paper paperclip while retaining functionality and binding quality.

The product can be reused repeatedly.

The product can be produced in various sizes, colours and shapes whereby certain functionalities can be accentuated. Examples of functionalities which can be accentuated more are the communicative value (promotional and illustrative by for example having a larger or different printing surface), joining of several sheets, larger marking area, archiving of documents with colour coding.

The invention has the clear added value for the business market (business-to-business) due to its environmentally friendly properties and the environmentally friendly appearance of the invention, the combined functionalities and the quality of the functionalities offered by the invention. One of the qualities of the invention is the intuitive function and speed of use of the invention. In addition the invention can be produced in standardised form (for example markable clips, unprinted clips, clips with standards illustrations or communication expressions) and offers an environmentally friendly alternative to existing paper binders such as traditional paperclips.

The product is functional for left- and right-handed people because the auxiliary construction protrudes symmetrically above and/or at the sides of the visible front surface.

The end product can be stacked by means of an adhesive layer on the end product, and thus also packed without damaging the end product. Stacking of the end product works on the same principle as stacking memo sheets of a post-it noteblock, wherein the sheets can also be removed each other while retaining function and without being damaged.

The paperclip can also be produced from other materials such as plastic.

To facilitate a detailed discussion of the embodiment, a number of expressions and terms are defined below.

In the description the term "rotation axis/pivot axis" is defined as an axis or point in relation to which a part (such as the auxiliary piece) can rotate or pivot. It does not necessarily mean an additional component such as a shaft, but this is possible. Such a rotation axis can for example also be formed by a fold seam in a wall, in relation to which part of the wall can pivot. Or it may be that an auxiliary piece is attached rotatably to a wall in another manner.

In the description the term "stack" is defined as at least two sheets. These sheets can also be made of any type of material. However the invention can also be used on just one sheet. The device is then attached to a corner of the sheet. In this case for example the promotional function can be emphasised by means of a logo on one of the walls of the device.

In the description the term "folding edge" is defined as an edge about which the end of the stack of sheets is folded when fitting the device.

The definition of "lever arm" is a mechanism with which a small force in combination with a large movement is converted into a small movement which shifts a great load, for which a large force is required. Therefore, in the invention there is a lever arm effect when the stack of sheets is moved over the entire predetermined distance into the cavity between the walls (for a corner device, this means into the corner and against the closed edges). The auxiliary piece protrudes at least at one location in the position of the stack of sheets. In addition the further it protrudes, the greater the lever arm effect. The lever arm effect is the greatest (and this is therefore the most advantageous embodiment) if the auxiliary piece in unfolded state stands perpendicular to the folding edge.

The "closed corner device" is defined in this description as the part of the paperclip which comprises the joined front surface with rear surface of the paperclip and the insertion space which is formed between the two surfaces, into which the paper can be inserted. In the claims such a construction is described further.

In FIG. 1 the first wall W1 and the second wall W2 are illustrated, which have closed edges CE1, CE2 for defining the space for receiving the stack of sheets. Also shown is a first opening O1 on a first end UE1 of the space for receiving the end of the stack of sheets.

FIG. 1 shows the front view of the end product of the paper paperclip. Here area A is the visible front surface of the paperclip. This part will also remain visible after the paperclip is attached to the stack of sheets and follows the rectangular form of the stack of sheets. Area B shows the front of the auxiliary construction (auxiliary construction HB) which is pushed to the rear on folding of the stack of sheets, whereby due to the lever arm effect (the stack of sheets follows the triangular form of area A and does not reach any further, whereby the auxiliary construction is larger than the corners of the stack of sheets which must be folded) the stack of sheets which must be joined is folded without great effort. Area C shows the support which serves to facilitate the insertion of the stack of sheets in the closed corner device. The part of the paperclip which consists of the joined front surface (area A) with rear surface (area C from the front view and area E from the rear view) of the paperclip and the insertion space between the two surfaces in which the paper can be inserted, is designated in this patent as the "closed corner device". Area C is the front of area E from FIG. 2. Line A1 is the underside of the front of the visual surface A of the paperclip.

Figure 2:
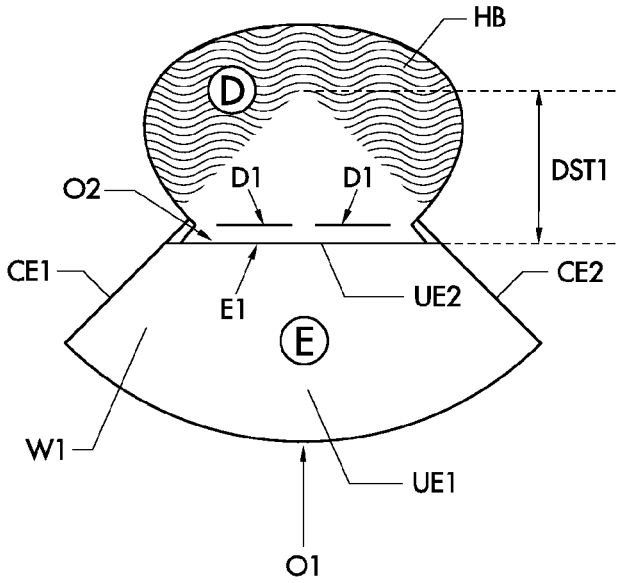
FIG. 2 shows the rear view of the paper paperclip in FIG. 1 in open state, wherein the auxiliary construction is not yet folded and wherein on the marked area on the auxiliary construction, an adhesive layer is applied which remains outside the form to which the stack of sheets to be joined can reach at maximum when inserted in the closed corner device of the paperclip.

FIG. 2 depicts the first wall W1 and the second wall W2 which have closed edges CE1, CE2 to define the space for receiving the stack of sheets. Also shown is the first opening O1 at a first end UE1 of the space for receiving the end of the stack of sheets and a second opening O2 at the second opposite end UE2 of the space. Furthermore FIG. 2 illustrates what is meant by the predetermined distance DST1 over which the stack of sheets protrudes in operational use. It appears from FIG. 2 that this distance is determined amongst others by the size of the second opening O2.

Figure 6:
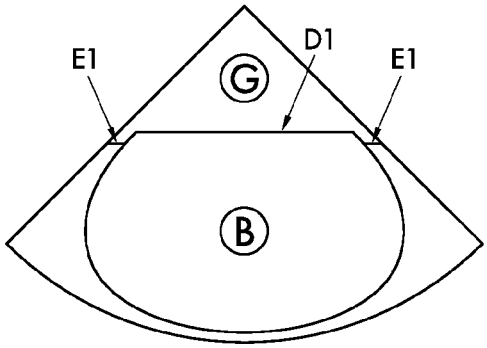
FIG. 6 shows the rear view of the paper paperclip in FIG. 1 in closed state in the case where the auxiliary construction is pushed on the rear surface. Functionally this could also be the front side of the device.

In FIG. 2 line E1 gives the folding line (folding edge) around which the corner of the stack of sheets to be joined is folded. Line D1 gives the folding line over which the auxiliary construction is folded. Folding line D1 resides a small distance above folding line E1 over which the stack of sheets is folded. The reason for this is that the folded paper obtains a certain thickness. If the space between D1 and E1 were not present, the auxiliary construction would be partly bent with the stack of sheets to be joined, whereby the height of area D (and B in the fixed state in FIG. 6) would be too small to be able to be attached securely. This would reduce the binding quality. FIG. 6 further shows an area G. This is part of the back side of the visible front surface A.

The invention can be produced from one piece of paper. It is also possible to produce the invention in parts, wherein the end product can have the same external features and the same functionalities as described in this application.

Figure 3:
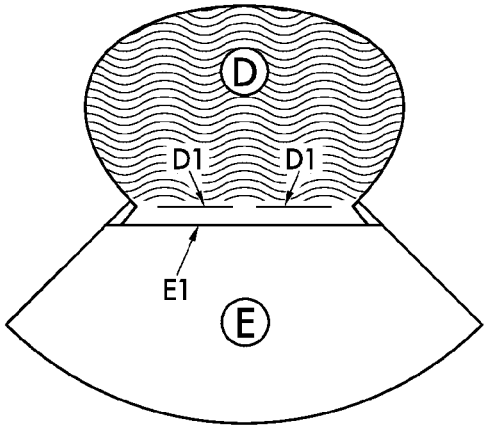
FIG. 3 shows the rear view of the paper paperclip in FIG. 1 in open state, wherein the auxiliary construction is not yet folded and wherein an adhesive layer is applied to the marked area on the entire auxiliary construction.
Figure 4:
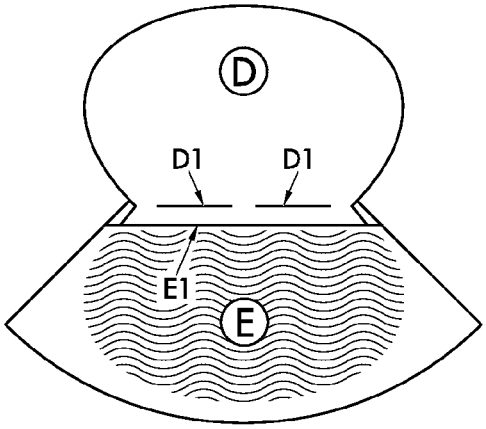
FIG. 4 shows the rear view of a paper paperclip in FIG. 1 in open state, wherein the auxiliary construction is not yet folded, and wherein an adhesive layer is applied to the marked area on the closed corner device.
Figure 5:
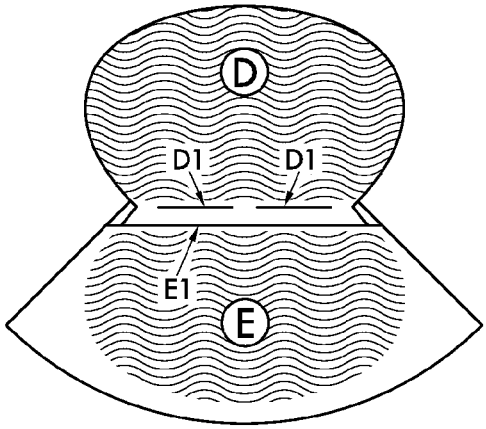
FIG. 5 shows the rear view of the paper paperclip in FIG. 1 in open state, wherein the auxiliary construction is not yet folded and wherein an adhesive layer is applied to the marked areas on the auxiliary construction and on the closed corner device.

In FIGS. 3, 4 and 5 there is shown a number of possible variants of the paper paperclip, wherein the hatched areas show where the adhesive layer may be applied in order to ultimately attach the auxiliary construction to the closed corner device in order to join a set of sheets.

Figure 7:
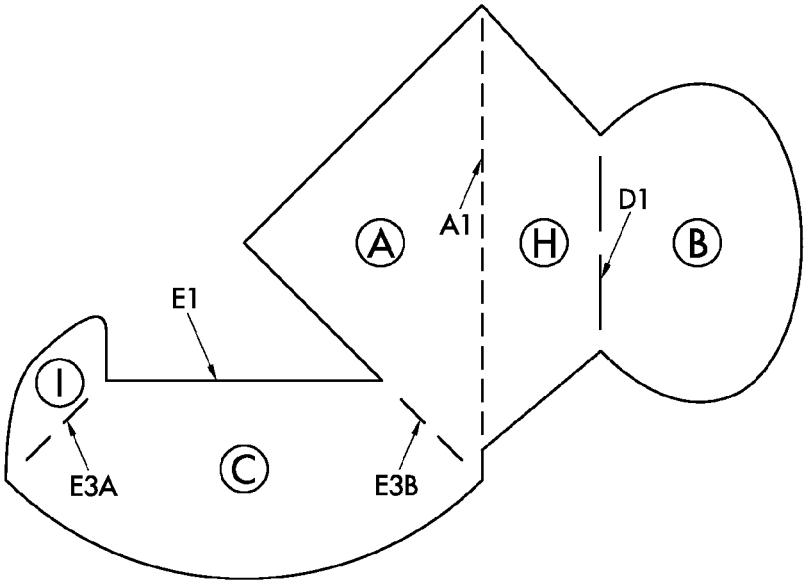
FIG. 7 is a preferred variant in accordance with further embodiments of the invention of the flat sheet model of the paper paperclip, wherein the paperclip has not yet been produced in the form of the end product.
Figure 8:
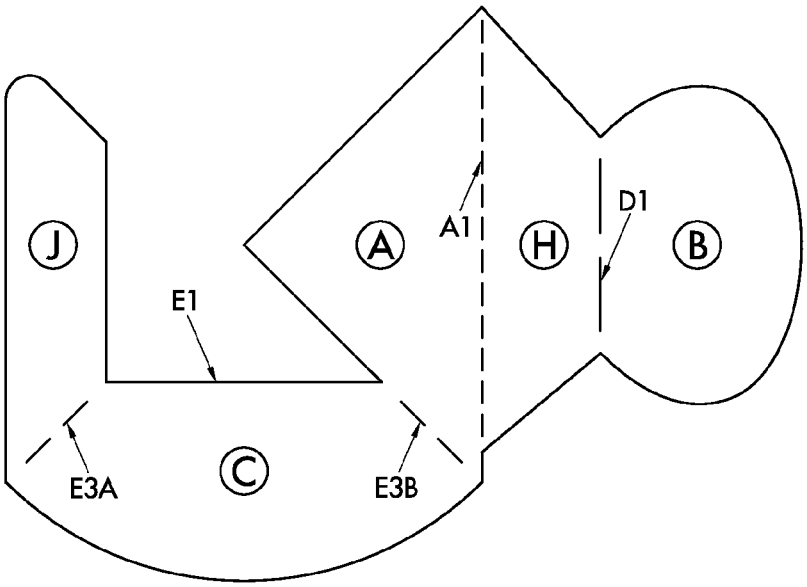
FIG. 8 shows a variant in accordance with a further embodiment of the invention of the flat sheet model of the paper paperclip, wherein the paperclip has not yet been produced in the form of the end product.
Figure 9:
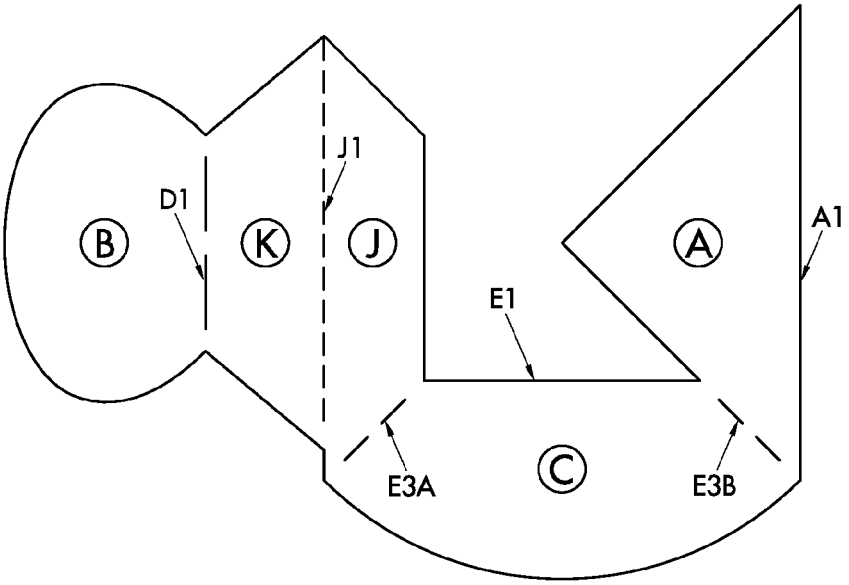
FIG. 9 shows a variant in accordance with a further embodiment of the invention of the flat sheet model of the paper paperclip, wherein the paperclip has not yet been produced in the form of the end product.

FIGS. 7 to 9 show variants of the flat sheet model of the invention where this is made from one piece of paper. The dotted lines A1, EA3, E3B, D1 and J1 in FIGS. 7, 8 and 9 are perforated or ribbed folding lines. In FIGS. 7 and 8 first the surface H is folded to the back against the visible front surface A. The back side of surface H can be glued to the back side of surface A. Because surface H is attached to the back side of the visible front surface A, surface H acts as a guide surface on insertion of the stack of sheets to be joined. Then surface I in FIG. 7 or surface J in FIG. 8 is folded backward over folding line E3A. A layer of glue is attached on surfaces I or J. Surface C is folded backward over folding line E3B, whereby surface I or J is glued against surface H. This gives the end product of this one embodiment of the invention, the paper paperclip.

FIG. 9 shows an alternative flat sheet model of the paper paperclip wherein first the surface K is folded forward over folding line J1 and wherein the front surface of surface K is glued against the front surface of surface K. Then surface J is folded backward about folding line E3A. On the back side of surface K is applied a glue layer which, after folding surface C to the back over folding line E3B, is glued to the back side of the visible front surface A. The advantage in this variant is that the visible front surface A is not connected in a straight line but can have other forms.

Figure 10:
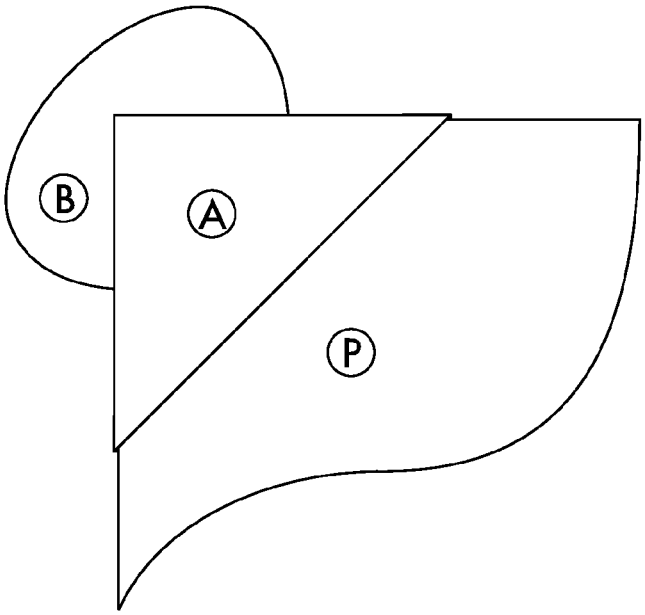
FIG. 10 shows a front view of the paper paperclip in accordance with the first embodiment of the invention in open state, showing how the visible part of the paper resides in the paperclip and where the auxiliary construction is visible.
Figure 11:
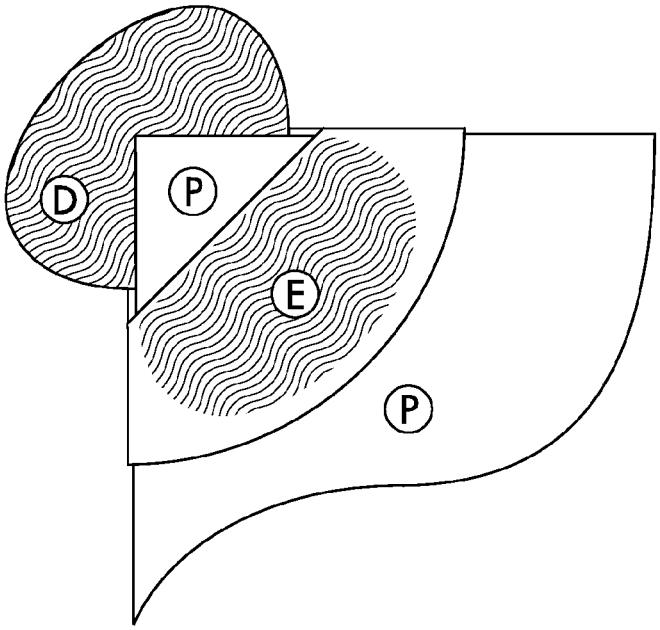
FIG. 11 shows a rear view of the paper paperclip in FIG. 10 in open state and shows how the visible part of the paper resides in the paperclip, wherein the auxiliary construction is not yet folded for attachment. The hatched areas show the possibilities for the adhesive layer which, after folding of the auxiliary construction including corners of the sheets of paper, joins the paper sheets by retaining these between the auxiliary construction and the closed corner device.
Figure 12:
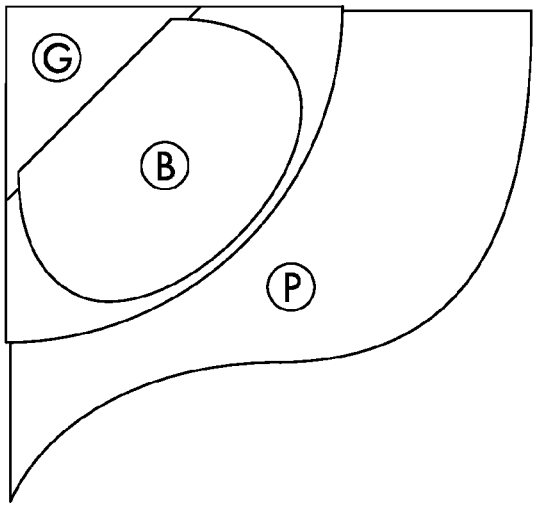
FIG. 12 shows the rear view of the paper paperclip in FIG. 10 in closed state, showing how the visible part of the paper resides in the paperclip, wherein the auxiliary construction is fixed against the back side of the paperclip.
Figure 13:
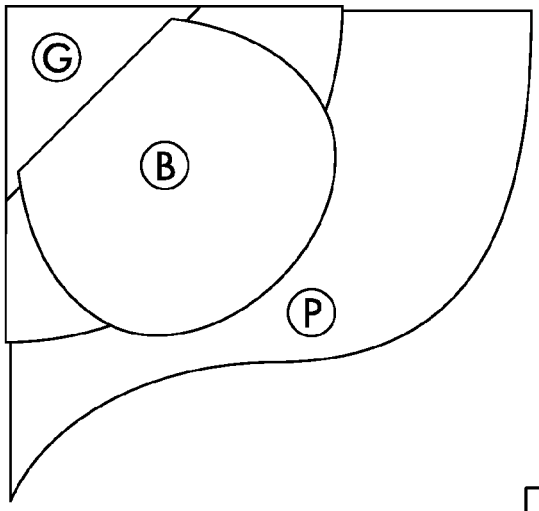
FIG. 13 shows the rear view of the paper paperclip in accordance with another embodiment of the invention in closed state, showing how the visible part of the paper resides in the paperclip, wherein the auxiliary construction is fixed to the back side of the paperclip and to a part of the stack of sheets to be joined.
Figure 14:
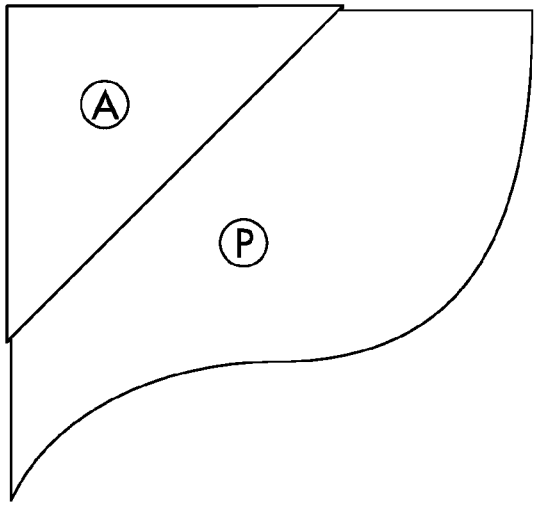
FIG. 14 shows the front view of the paper paperclip in FIG. 10 in closed state, showing how the visible part of the stack of sheets resides in the paperclip.

FIG. 10 shows how the stack of sheets P in the closed corner device of the paperclip appear in open state in relation to the visible front surface A, wherein the front of the auxiliary construction B is still visible. FIG. 11 shows the back side of the paperclip in open state, clearly revealing how the stack of sheets P resides in the closed corner device and how the adhesive layer is attached to the auxiliary construction at surface D according to FIG. 2. FIG. 12 shows the paperclip in closed state, clearly revealing how the paper P resides in the clip in closed state. Area G is the back side of the visible front surface A and area B is the front side of the auxiliary construction in closed state. FIG. 13 shows the paperclip in accordance with another embodiment of the invention. This paperclip has a larger auxiliary construction (=auxiliary piece) whereby it reaches on folding beyond the corner device and is able to make physical contact with the top sheet of the stack of sheets. In this embodiment it is possible to attach the auxiliary piece to the top sheet for example by means of an adhesive layer. This gives a stronger construction. Finally, FIG. 14 shows the front view of the paperclip in closed state where it is visible how the stack of sheets P resides in the paperclip and wherein area A is the visible front surface.

Figure 15:
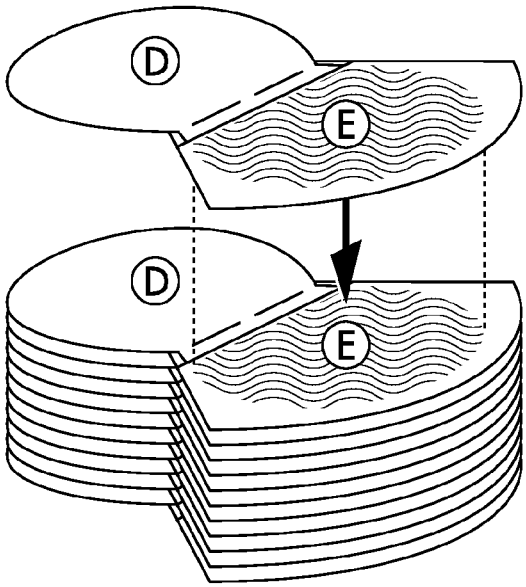
FIG. 15 shows how the paper paperclips can be stacked in accordance with a further embodiment of the invention, viewed from the back side of the paperclips, making use of the adhesive layer which is also used to attach the auxiliary construction to the closed corner device. The adhesive layer is shown hatched.
Figure 16:
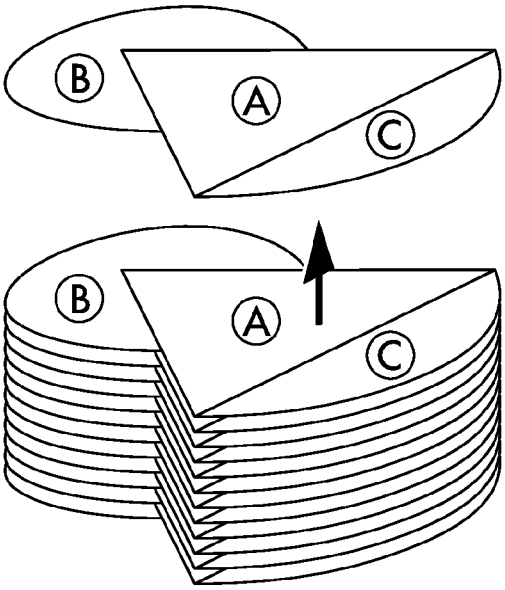
FIG. 16 shows how the paper paperclips in FIG. 15 are stacked viewed from the front of the paperclips, wherein use is made of the adhesive layer which is also used to attach the auxiliary construction to the closed corner device.

FIG. 15 shows the back sides of the paper paperclip in the stacked position. Area D is here the back view of the auxiliary construction and area E is the back side of the closed corner device. The paperclips remain stacked at their position by the adhesive layer which is shown hatched on area E. FIG. 16 shows a front view of the stacked paperclips.

Figure 17:
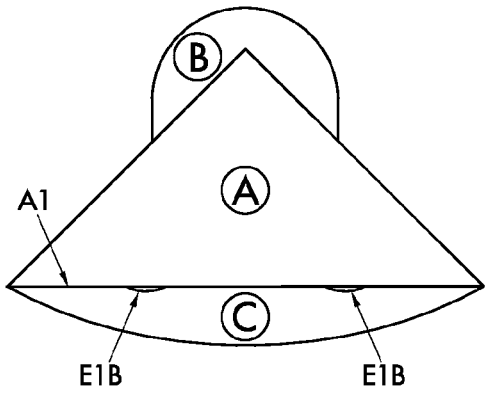
FIG. 17 shows the front view of the paper paperclip in accordance with a further embodiment of the invention in open state, wherein the triangular part forms the visible front view of the paperclip when the paperclip is attached to the stack of sheets and wherein the round form above the triangular form represents the auxiliary construction in unattached form.
Figure 18:
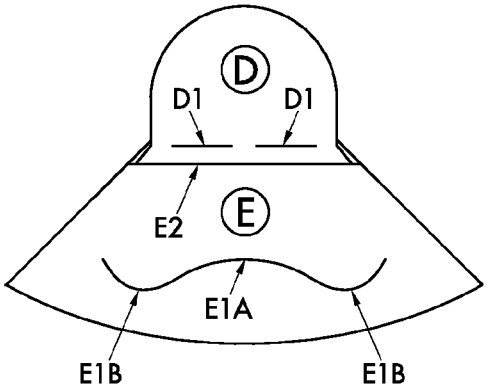
FIG. 18 shows the rear view of the paper paperclip in FIG. 17 in open state, wherein the auxiliary construction is not yet folded and pushed in the fixing cut.

FIG. 17 shows the front view of the paper paperclip. Area A is the visible front side of the paperclip. This part will also remain visible after the paperclip is attached to the stack of sheets and follows the form of the stack of sheets. Area B shows the front of the auxiliary construction, area C shows the support which facilitates the insertion of the stack of sheets for joining. This is the front of area E from FIG. 18. Apart from that, the insertion of the stack of sheets could be made more difficult, because of the stack of sheets being pushed into the fixing cut instead of completely into the paperclip. FIGS. 20 and 21 show a guiding construction (E3) which when folded comes to reside on surface E and protrudes beyond the highest point of the fixing cut E1A. As a result the paper can no longer catch. Line A1 in FIG. 17 is the underside of the front of the visible surface A of the paperclip. E1B which is visible twice below line A1 shows the lowest part of the fixing cut which in FIG. 18 is marked as E1A and E1B. The fixing cut is a fully perforated line. By exerting pressure at the base of surface E below the fixing cut E1A and E1B, point E1A lifts whereby the auxiliary construction (area D in unattached state and area B in FIG. 19 in attached state) can easily enter the fixing cut, securing the auxiliary construction behind the fixing cut as shown in FIG. 19. In FIG. 18 line E2 gives the folding line about which the stack of sheets to be joined is folded. Line D1 shows the folding line over which the auxiliary construction is folded. FIG. 19 further shows area G. This is part of the back side of the visible front surface A.

Figure 22:
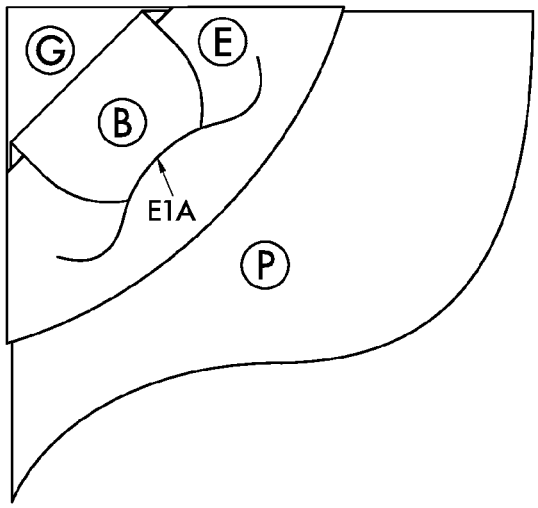
FIG. 22 shows the rear view of a paper paperclip in FIG. 17 showing how the paper resides in the paperclip when the auxiliary construction is pushed into the fixing cut.
Figure 23:
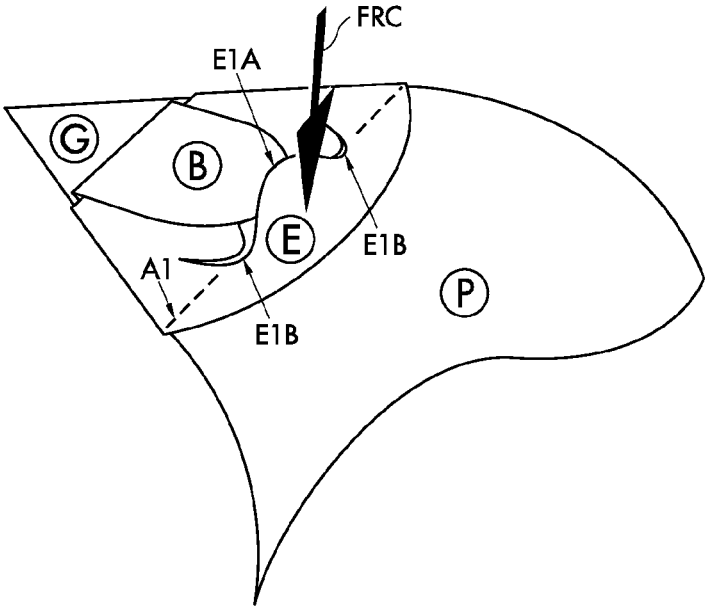
FIG. 23 shows a detail of the paper paperclip in FIG. 17 showing three-dimensionally where on the pivot construction pressure must be exerted to attach the auxiliary construction to or remove it from the pivot construction.
Figure 24:
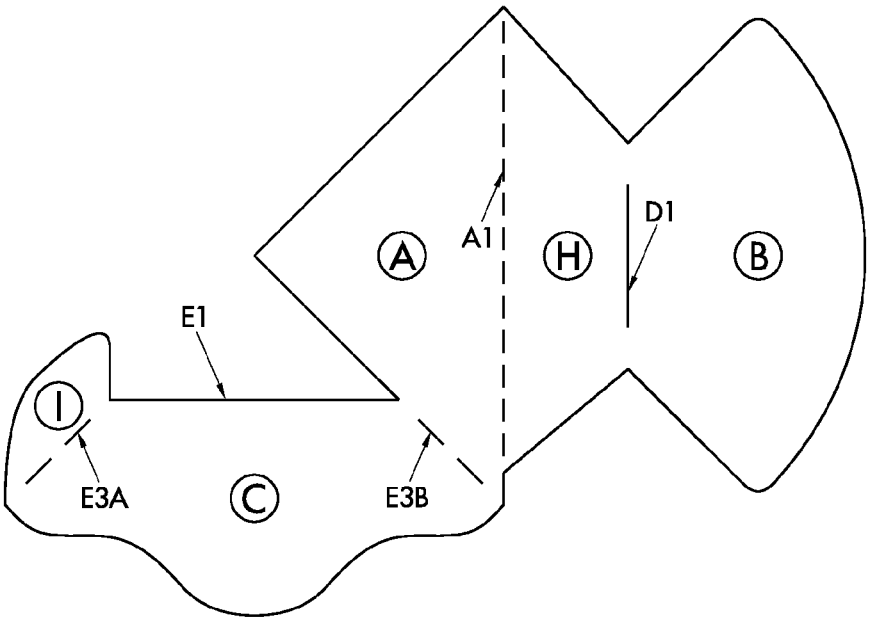
FIG. 24 shows a variant of the flat sheet model in FIG. 20 of the paper paperclip with an adhesive layer as a binding principle, wherein the paperclip is not yet produced in the form of the end product.
Figure 25:
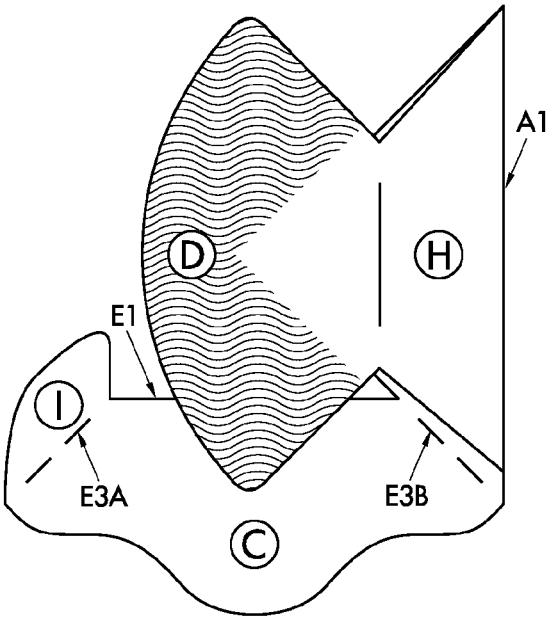
FIG. 25 shows how the flat sheet model of FIG. 24 appears in the manufacturing process after the first folding movement, wherein the auxiliary construction is folded inwards and this is not yet glued to the back side of the visible front surface.
Figure 26:
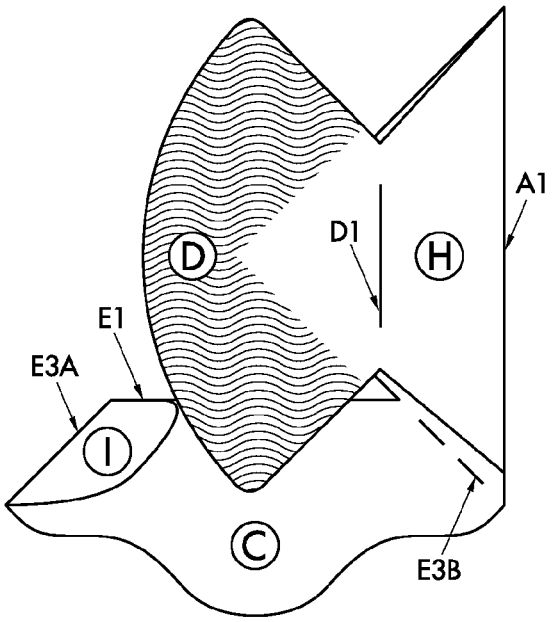
FIG. 26 shows how the flat sheet model in FIG. 24 appears in the manufacturing process after the second folding movement, wherein the wing which is finally glued to the surface below the folding line of the auxiliary construction is folded inwards and wherein the hatching indicates the adhesive layer.
Figure 27:
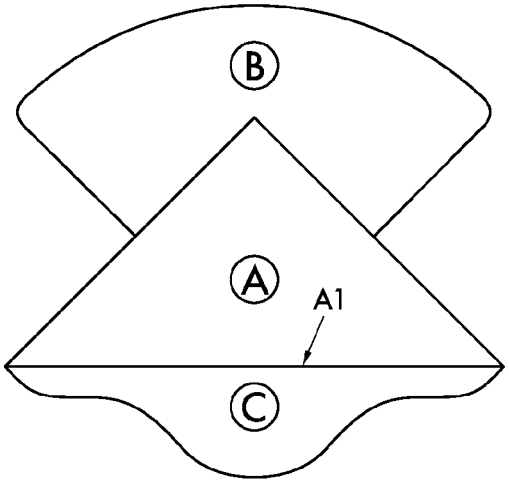
FIG. 27 shows how the flat sheet model of FIG. 24 appears in the manufacturing process after the third folding movement, wherein the inwardly folded wing with adhesive layer is attached to the underside of the auxiliary construction. This is an end product of the paperclip with adhesive layer as a binding principle.
Figure 28:
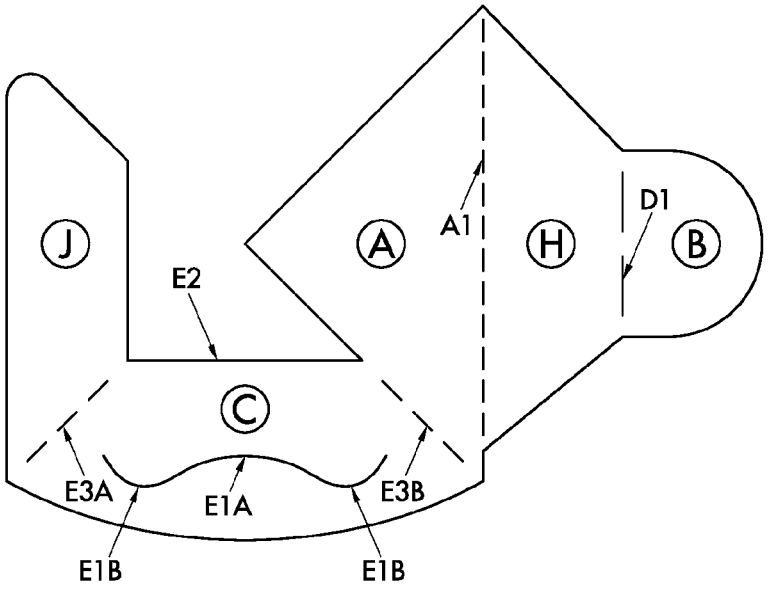
FIG. 28 shows a further variant of the flat sheet model in FIG. 20 of the paper paperclip with a retaining system as binding principle, wherein the paperclip is not yet produced in the form of the end product.
Figure 29:
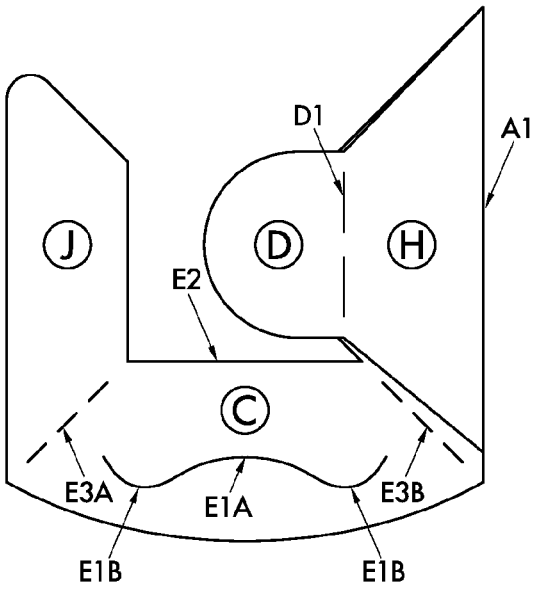
FIG. 29 shows how the flat sheet model of FIG. 28 appears in the manufacturing process after the first folding movement, wherein the auxiliary construction is folded inwards and this is not yet glued to the back side of the visible front surface.
Figure 30:
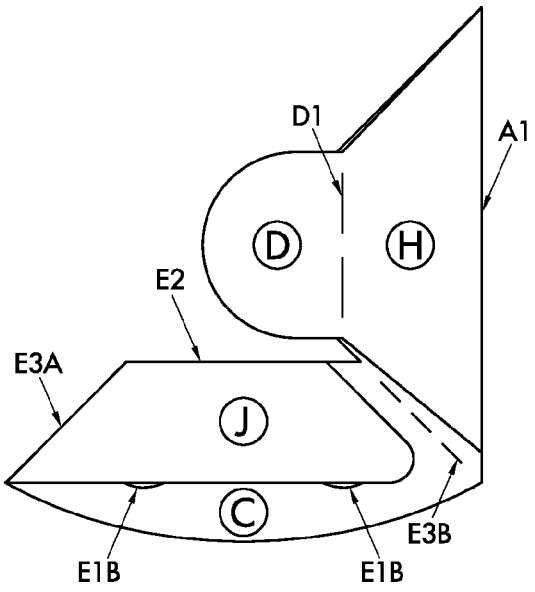
FIG. 30 shows how the flat sheet model of FIG. 28 appears in the manufacturing process after the second folding movement, wherein the wing which is finally glued to the surface below the folding line of the auxiliary construction, is folded inwards and wherein the hatching indicates the adhesive layer.
Figure 31:
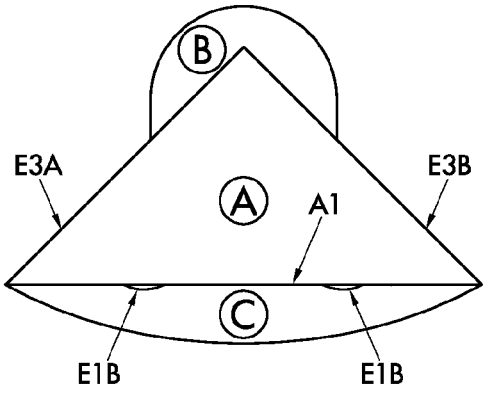
FIG. 31 shows how the flat sheet model of FIG. 28 appears in the manufacturing process after the third folding movement, wherein the inwardly folded wing with adhesive layer is attached to the underside of the auxiliary construction. This is the end product of the paperclip with a retaining system as a binding principle.

FIGS. 22 and 23 show the back side of the paperclip wherein auxiliary construction B is visible and remains attached in the fixing cut, because the auxiliary construction resides partly below E1A. FIG. 23 again explicitly shows how the pivoting construction of the fixing cut works. The fixing cut comprising the punched line (E1A, E1B) pivots over pivot line A1 when a force FRC is exerted downward on the part below the fixing cut in area E. As a result E1A lifts whereby the auxiliary construction can easily be pushed under the fixing cut.

FIGS. 24 to 27 show the steps of the manufacturing process of the paperclip with adhesive layer as a binding principle, wherein the steps comprise three folding movements and one or two adhesive joints.

FIGS. 28 to 31 show the steps of the manufacturing process of the paperclip with a retaining system as binding principle, wherein the steps comprise three folding movements and one or two adhesive joints.

A number of embodiments of the invention are described below:

1. The embodiment comprises a paper paperclip characterized in that the stack of sheets which must be joined is pushed into a "closed corner device" and folded around a folding edge of the "closed corner device" of the paper paperclip, wherein "closed corner device" is defined as the part of the paperclip which consists of the joined front side with back side of the paperclip and the insertion space which resides between the two surfaces and into which the paper can be inserted.
2. A paper paperclip according to embodiment 1 characterized in that the stack of sheets is folded by the auxiliary construction which is larger than the "flaps" of the stack of sheets which must be joined, whereby the auxiliary construction including the stack of sheets can be folded with little effort via a lever arm effect.
3. A paper paperclip according to embodiment 1 or 2 characterized in that the auxiliary construction is attached to the paperclip by means of an adhesive on the auxiliary construction or on the side of the closed corner device where finally the auxiliary construction is attached joining the stack of sheets, so that the stack of sheets can be retained by the auxiliary construction which adheres to the "closed corner device" and/or part of the stack of sheets.
4. A paper paperclip according to embodiment 1 or 2 characterized in that a fixing cut which resides on the back side of the invention can be opened by a pivoting construction pivoting over the visible front side of the front surface by exerting pressure on the lower edge of the pivoting construction, whereby it opens and guarantees the insertion of the auxiliary construction, after which the pivoting construction returns to its original position and the paperclip is attached, joining the stack of sheets.
5. A paper paperclip according to embodiment 1, 2 or 4 characterized in that the pivoting construction is positioned so that the underside (lowest two points of the pivoting construction) of the fixing cut is positioned just below the lower edge of the visible front side, whereby the pivoting construction opens optimally when pressure is exerted on the underside of the rear (below the fixing cut).
6. A paper paperclip according to embodiment 1, 2 or 3 characterized in that the auxiliary construction, after insertion of the stack of sheets which must be joined, is visible on the front side, whereby it is intuitive for the user to fold this in the correct direction to attach the auxiliary construction to the "closed corner device" and/or a part of the stack of sheets for retention, thus joining the stack of sheets.
7. A paper paperclip according to embodiment 1, 2, 3 or 4 characterized in that by means of the adhesive layer used to attach the auxiliary construction to the "closed corner device", the paperclips can be stacked glued together and also packed thus without damaging the paperclip and while retaining functionality.
8. A paper paperclip according to embodiment 1, 2, 3, 4 or 5 characterized in that the paperclip can also be produced in materials other than paper.

The invention relates to a device for holding together a stack of sheets which has a good binding quality, is simple, intuitive and quick to attach, offers multiple functionalities, uses sustainable materials and can be used safely. Because of the simple construction, the invention can be manufactured cheaply and quickly and offers a good solution for the business market wherein speed of attachment, good binding quality and a sustainable appearance together with the combined functionalities (joining paper, promotional expression by means of printed logos on the clip, marking possibilities) offers added value in comparison with existing solutions. For the retail market the invention also offers a good alternative to existing solutions. Certain embodiments of the invention are cheap, sustainable, function well and offer numerous possibilities for application. The function of the invention is based on a number of basic principles, the most important of which are: visually clearly distinguished areas renders the use intuitive, by using a lever arm effect minimises the effort required for fixing, by using, in certain embodiments, an adhesive layer or a retaining system the fixing requires particularly few actions, whereby the invention is simple, intuitive and functions appropriately.

The invention can be used in various application areas. It can be used amongst others in office environments, but also certainly in all households.

Various variations of the invention and the embodiments described here are possible. However, these do not fall outside the scope of protection of the invention as defined in the claims.

It must be noted that the above embodiments illustrate the invention rather than limiting it and that the skilled person will be able to come up with many alternative embodiments without going outside the scope of protection of the attached claims.

The claims use reference Figures in brackets and these should not be interpreted as limiting the claims. The term "comprise" and its additions do not exclude the presence of elements or steps other than those cited in the claims. The word "a" which stands before an element does not exclude the possibility of several of the elements being able to be present. The invention can be implemented as a device but also as an intermediate product. In the device claims, various means can be named with which several of such means are performed in one and the same piece of hardware. All dependent claims can be combined unless explicitly stated or evidently impossible. In the Figures same or corresponding properties or elements are indicated with same reference numerals.

The invention claimed is:

1. A device for holding together an end of a stack of sheets, wherein the device has a front and a back side, the device comprising:

(a) a first wall on the back side of the device and a second wall on the front of the device, wherein (i) the first wall and the second wall are positioned in a substantially facing relationship to one another, wherein the first and second walls are joined together so as to define a space with a first opening at a first end of the space to receive the end of the stack of sheets, and a second opening at a second end of the space opposite the first end thereof; and wherein (ii) the first wall forms a first folding edge in the second opening, and wherein (iii) the second opening is adapted to allow the end of the stack of sheets to protrude over a predetermined distance in relation to the first folding edge when the stack of sheets resides in the space during operational use; and (b) an auxiliary piece which is pivotably attached to a rear side of the second wall near the second opening via a pivot point, wherein the auxiliary piece and the pivot point are configured and positioned in relation to the first folding edge such that, during operational use, the auxiliary piece is able to fold, the end of the stack of sheets about the first folding edge (E1) in a direction of a back side of the first wall via a lever arm effect acting on the end of the stack of sheets to achieve a folded state of the stack of sheets, and wherein the auxiliary piece is configured such that it protrudes, during operational use, in an unfolded state of the stack of sheets, at least at one location further than the end of the stack of sheets so that the auxiliary piece is able to make physical contact with the first wall in the folded state of the stack of sheets, and wherein the auxiliary piece is pivotably attached on the rear side of the second wall such that after folding the stack of sheets in the direction of the back side of the first wall, the front of the device defines a right angle to maintain a rectangular form of the sheets which the sheets had in the unfolded state thereof.

2. The device according to claim 1, further comprising an intermediate wall which attaches the auxiliary piece to the second wall.

3. The device according to claim 1, wherein the first wall close to the first opening of the space extends further than the second wall in order to create a support to facilitate insertion of the stack of sheets in the space.

4. The device according to claim 1, wherein the auxiliary piece protrudes further than the predetermined distance of the end of the stack of sheets by a factor in a range of 1 to 3.

5. The device according claim 4, wherein a size of the second opening is configured such that it establishes the predetermined distance.

6. The device according to claim 5, wherein the second opening has a length which is in a range of 10 mm to 60 mm.

7. The device according to claim 1, wherein the auxiliary piece is configured such that it protrudes during operational use in an unfolded state of the stack of sheets so far that in the folded state of the stack of sheets, the auxiliary piece is able to make physical contact with a respective outermost sheet of the stack of sheets at a location beyond the first wall.

8. The device according to claim 1, further comprising an adhesive layer provided on at least one of the auxiliary piece and a receiving side of the first wall so that the auxiliary piece during operational use, adheres to the first wall in the folded state of the stack of sheets.

9. The device according to claim 1, wherein the first wall is provided with a cut, which is positioned and configured such that the auxiliary piece during operational use, can be pushed at least partly into the cut in the folded state of the stack of sheets, thereby securing the auxiliary piece.

10. The device according to claim 1, further comprising an adhesive layer provided on at least one of the first wall and the auxiliary piece on one side thereof.

11. The device according to claim 1, wherein the first wall and the second wall are formed such that they form a corner device to receive a corner point of the stack of sheets.

12. The device according to claim 11, wherein the corner device has closed edges which together, form an angle in the range of 60° to 120° as viewed in projection on a plane of the first wall, and wherein the first folding edge makes an angle in the range of 30° to 60° with at least one of the closed edges of the corner device.

13. The device according to claim 1, wherein the first wall, the second wall and the auxiliary piece are formed of a material selected from the group consisting of paper, plastic, wood, metal, biological materials, and mixed forms thereof.

14. The device according to claim 1, wherein the first wall, the second wall and the auxiliary piece are made of one piece.

15. A stack of devices according to claim 1.

* * * * *